United States Patent [19]

Kenny

[11] Patent Number: 5,074,417

[45] Date of Patent: Dec. 24, 1991

[54] LUNCH BOX HAVING A SIMULATIVE EXTERIOR CONFIGURATION AND AN INTERACTIVE FIGURE

[75] Inventor: Carrie E. Kenny, King Ferry, N.Y.

[73] Assignee: Cornell Research Foundation, Inc., Ithaca, N.Y.

[21] Appl. No.: 681,904

[22] Filed: Apr. 8, 1991

[51] Int. Cl.[5] ..... B65D 81/36

[52] U.S. Cl. ..... 206/542; 206/457; 446/73

[58] Field of Search ..... 206/457, 541, 542, 549; 446/72-75, 77

[56] References Cited

U.S. PATENT DOCUMENTS

| | | | |
|---|---|---|---|
| D. 208,220 | 8/1967 | Frost . | |
| D. 299,898 | 2/1989 | Pashley . | |
| 1,662,899 | 3/1928 | Rideway et al. . | |
| 1,698,731 | 1/1929 | Otto | 206/457 |
| 2,084,308 | 6/1937 | Behr | 206/457 |
| 2,748,527 | 6/1956 | Seals | 446/71 |
| 3,440,747 | 4/1969 | Oliver | 446/73 |
| 4,435,915 | 3/1984 | Zaruba | 446/75 |
| 4,527,688 | 7/1985 | Jones et al. | 206/457 |
| 4,666,042 | 5/1987 | Dlott et al. . | |
| 4,712,673 | 12/1987 | Moore . | |
| 4,787,874 | 11/1988 | Hardy | 206/457 |
| 4,815,999 | 3/1989 | Ayon et al. . | |

*Primary Examiner*—Jimmy G. Foster
*Attorney, Agent, or Firm*—Jones, Tullar & Cooper

[57] ABSTRACT

A child's lunch box has an exterior configuration which is simulative of a selected motif. An exteriorly accessible compartment further carries both the selected motif. An interactive figure is positionable in the exteriorly accessible compartment and is costumed to cooperate with and to interact with the exterior motif of the lunch box.

11 Claims, 5 Drawing Sheets

LUNCH BOX HAVING A SIMULATIVE EXTERIOR CONFIGURATION AND AN INTERACTIVE FIGURE

FIELD OF THE INVENTION

The present invention is directed generally to a child's lunch box. More particularly, the present invention is directed to a child's lunch box having a simulative exterior configuration. Most specifically, the present invention is directed to a child's lunch box having a simulative exterior configuration and an interactive figure. The simulative exterior configuration of the lunch box may take one of any number of shapes, such as a space rocket, firehouse, castle, or the like. A portion of this exterior configuration forms either an integral insulated container or provides an interior space sized to receive a beverage container. The interactive figure, such as a spaceman, fireman, princess or knight is positionable in an exteriorly accessible compartment. The interior of this compartment continues the theme or motif depicted by the simulative exterior of the lunch box. The interactive figure is removable from its exteriorly accessible compartment and is usable for play with the lunch box.

DESCRIPTION OF THE PRIOR ART

Children from early pre-school through elementary grades often have need for a lunch box. Such a box is, of course, needed to transport and store a lunch or snack and beverage while the child is attending school, camp, is visiting a friend, or participating in a picnic or the like. This lunch box needs to be sturdy, easily transportable, and generally utilitarian. There are any number of lunch boxes presently available which satisfy these criteria. These presently available lunch boxes are also often very boring to the child and thus are often forgotten, not used, ignored and not thought about.

As any parent will attest, a child's interest in eating often has little to do with the food itself. The most visually stimulating and tasty meal may well be ignored if the child is either not ready or willing to eat, or is distracted by other happenings. Similarly, a rather bland, uninteresting meal will be rapidly consumed if the child believes that it relates to his or her favorite cartoon, or television hero. A trip to any toy store will provide support for this theory based on the wide variety of child's lunch boxes that are available. The majority of these lunch boxes are provided with bright colors and visual graphics. However, they do not provide a structure with which the child can truly interact.

Most children have very active imaginations which will allow a child to engage in extended play with an object that appeals to him. The play object must provide some motivation for the play. A lunch box which is provided with graphic scenes of favorite characters is visually attractive but the attraction quickly fades when the child realizes that there is little possibility to actually interact with the lunch box.

A child is more apt to care for and to remember an object or play article that appeals to the child. A review of the contents of any lost and found collection in a typical pre-school or elementary school will result in the discovery of any number of lunch boxes. More often than not, these have been left behind on the school bus, in the cafeteria, or on the playground by an owner who was not particularly attached to the lunch box and who was not overly concerned about keeping it with him.

Although most forgotten lunch boxes usually eventually find their way back to their owner, some never do and must be replaced. Even the ones that do return often do so only after a sufficient period of time that they have been replaced.

It will thus be apparent that a need exists for a child's lunch box which will overcome the shortcomings of the prior art devices. The lunch box of the present invention provides such a device and is a significant improvement over prior art devices.

SUMMARY OF THE INVENTION

It is an object of the present invention to provide a child's lunch box.

Another object of the present invention is to provide a child's lunch box having a simulative exterior.

A further object of the present invention is to provide a child's lunch box having an exterior compartment.

Still another object of the present invention is to provide a child's lunch box having an interactive figure.

Yet a further object of the present invention is to provide a child's lunch box having a simulative exterior configuration including an insulated beverage receiving compartment.

As will be discussed in greater detail in the description of the preferred embodiments which are set forth subsequently, the present invention is directed to a child's simulative lunch box which also includes an interactive figure that is carried in an exterior compartment. In the preferred embodiment, the exterior of the lunch box is configured to simulate a rocket ship. The interactive figure is depicted as a spaceman and is positionable in an exteriorly accessible compartment with an interior configuration representative of a rocket or space ship's interior. The lunch box, while being generally rectangular, has an exterior portion which, in the depicted embodiment, forms the body of the rocket. This portion of the box may be an insulated receptacle for beverages, or may provide an enlarged interior storage compartment which will receive a separate insulated beverage container or a generally conventional can of soft drink, carton of milk, box of juice or the like.

The simulative exterior of the lunch box, together with the interactive figure, attracts the child to the box and keeps his attention during consumption of the contents of the box. The color scheme of the exterior of the box can be made as vivid and individual as desired. Thus even though multiple boxes having the same overall exterior shape may be made, each may be colored differently. In addition, one or more individualized interactive figures can be provided for each box. In this way, the child will be able to relate to, and associate with, his own box. This association and interaction will keep the child's attention during meal time and will encourage the child to eat the food carried in the lunch box.

The lunch box and the figure or figures carried in the exterior compartment of the box are selected and provided so that they will interact with each other. Thus the child can use the box and figure as props for any number of games and other play activities that his mind will create. In this way the lunch box of the present invention is far superior to prior devices which may have initially attracted the child's attention but did nothing to hold it.

The lunch box of the present invention will be treated as more than just another food-carrying device by the child. Instead of being forgotten or ignored like a paper bag, the lunch box of the present invention will be a meaningful possession to the child. It is something that the child can have fun with and thus will want to keep with him. Since it is a play object, as well as a lunch box, it will not be as likely to be forgotten or misplaced.

The lunch box of the present invention is not only functional, it is also fun. It allows the child to exercise his imagination while aiding him in the consumption of his lunch or snack. Its interactive capabilities ensure that it will be used and enjoyed. Thus the lunch box of the present invention is a substantial advance in the art.

BRIEF DESCRIPTION OF THE DRAWINGS

While the novel features of the lunch box in accordance with the present invention are set forth with particularity in the appended claims, a full and complete understanding of the invention may be had by referring to the detailed description of the preferred embodiments which are set forth hereinafter, and as illustrated in the accompanying drawings, in which:

DETAILED DESCRIPTIONS OF THE PREFERRED EMBODIMENTS

Figure 1:
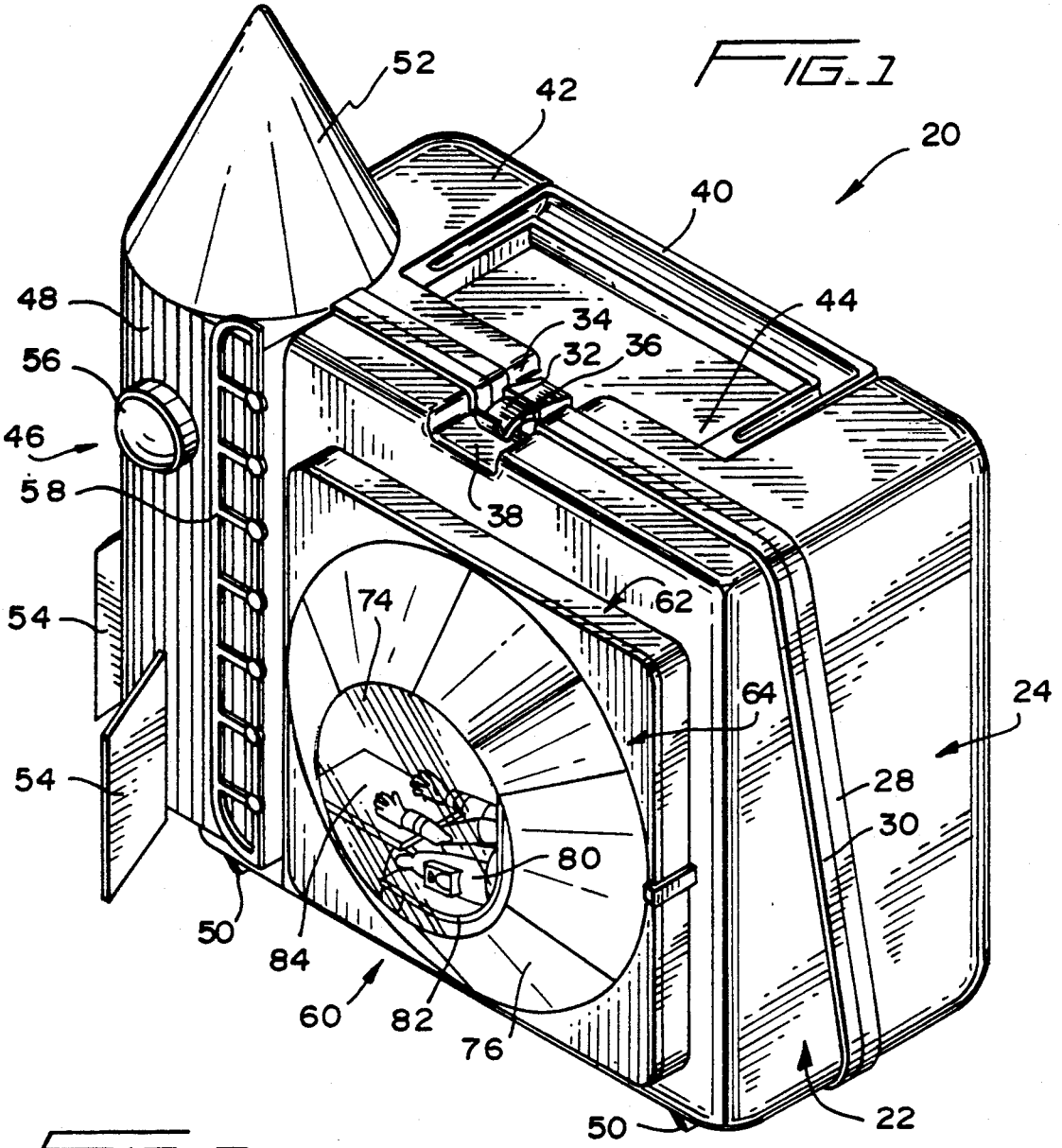
FIG. 1 is a front perspective view of a first preferred embodiment of a lunch box in accordance with the present invention.
Figure 2:
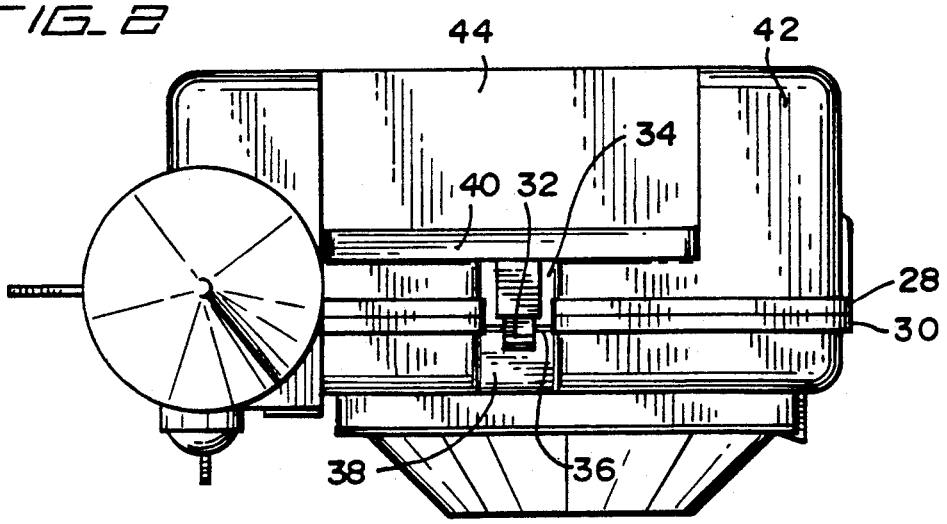
FIG. 2 is a top plan view of the lunch box of FIG. 1.
Figure 3:
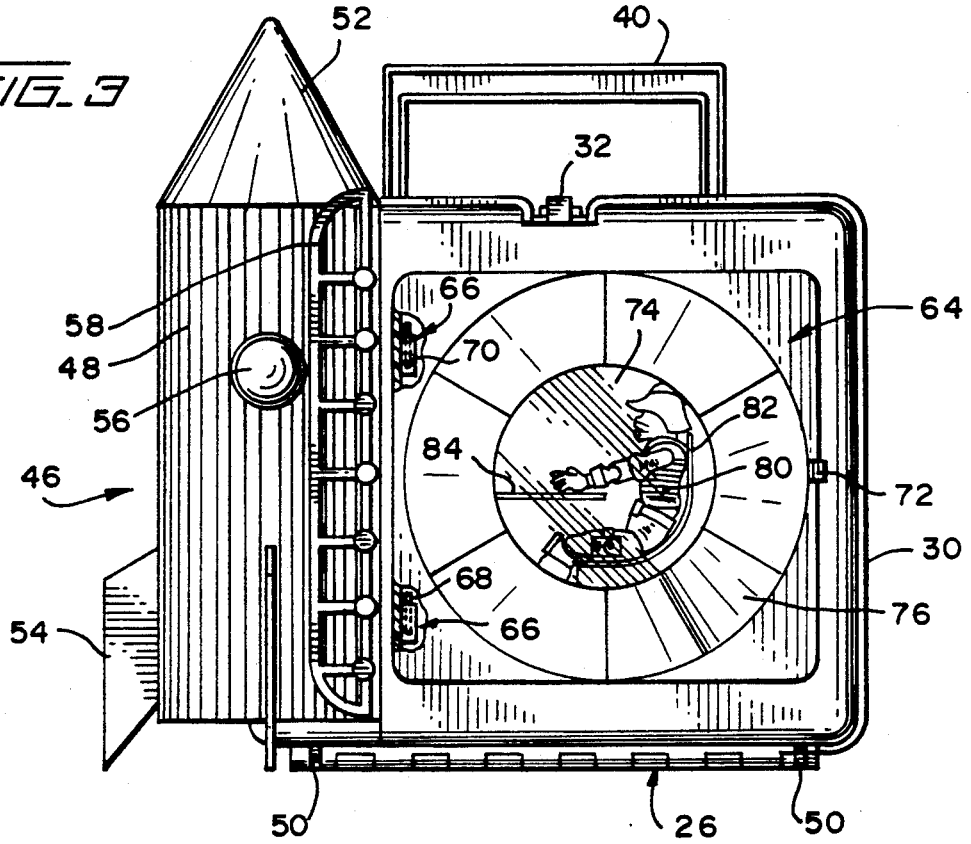
FIG. 3 is a front elevation view of the lunch box.

Referring initially to FIG. 1, there may be seen, generally at 20, a first preferred embodiment of a lunch box in accordance with the present invention. Lunch box 20 is depicted as being generally rectangular in overall shape. It has a front cover, generally at 22, and a rear body, generally at 24, which are hingedly connected by an elongated piano type bottom hinge, generally at 26, as may be seen in FIG. 3. Body 24 of lunch box 20 has a mouth rim 28 which engages with a cooperatively shaped cover mouth rim 30. A spring steel or similar cover latch 32 is carried in a body recess 34. The cover latch 32 is engageable with a cover latch seat 36 which is positioned in a cooperating cover latch seat recess 38. A generally U-shaped lunch box handle 40 is pivotably attached to an upper surface 42 lunch box body 24 and is pivotable about suitable pivot pins (not shown) between a raised, use position, as depicted in FIG. 3 and a lowered storage position where handle 40 is receivable in a storage well 44 in the top surface 42 of the body 24 of the lunch box 20. This abovedescribed lunch box shape is generally conventional and is therefore not set forth in great detail. It will be understood that while the lunch box will be discussed as being generally rectangular, that other shapes, such as square, trapezoidal, ovoid and the like are within the scope of the present invention. It will further be understood that the lunch box will preferably be made using suitable moldable plastic compositions. Other materials, such as metal, wood and the like could also be utilized.

Referring again to FIG. 1, as well as to FIGS. 2–7, the body 24 of the lunch box 20 includes a generally rocket ship shaped portion, generally at 46. The rocket ship 46 is formed on body 24, generally at the left front corner of the body 24, as seen in FIG. 1. This rocket ship 46 includes a generally cylindrical rocket body 48 with the axis of the cylinder being generally vertical when the lunch box 20 is resting on support feet 50. A nose cone 52 is positioned atop cylindrical rocket body 48. Spaced, radially outwardly directed fins 54 are secured to the lower portion of rocket body 48 and cooperate with support feet 50 to keep the lunch box 20 in a stable upright position. A simulative viewport 56 may be provided on the side of cylindrical rocket body 48. A ladder 58 may also be secured to the side of cylindrical rocket body 48.

Figure 10:
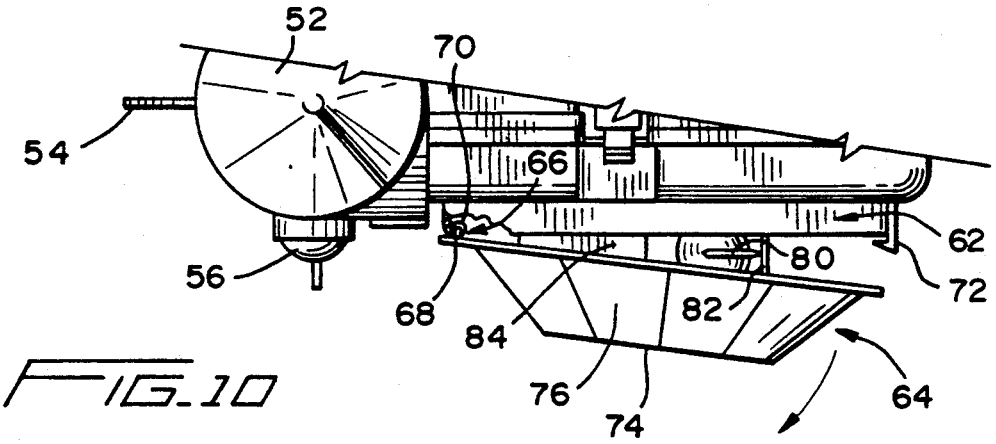
FIG. 10 is a top plan view of the lunch box, generally similar to FIG. 7 and showing the door to the exterior compartment opened.

Cover 22 of lunch box 20 includes, as may be seen in FIGS. 1, 2, 3, 5, 7 and 10, an exteriorly accessible compartment generally at 60. Compartment 60 is defined by a generally square or rectangular flange, generally at 62 which cooperates with a cooperatively shaped front door, generally at 64. This compartment door 62 is openable with respect to flange 62 by use of a suitable hinge pin and pintle assembly, generally at 66, as seen in FIGS. 3 and 10. Hinge pins 68 on the door 64 will be received in suitable hinge pintles 70 on the compartment flange 62. This will allow the door, generally at 64, to be supported for swinging motion with regard to the compartment defining flange 62. A suitable resilient plastic latch 72 for the compartment door 64 is molded on an exterior surface of flange 62 generally opposite to compartment door hinges 66.

A transparent plastic porthole generally at 74 is provided on compartment cover 64. This porthole 74 is supported by a truncated cone-shaped support ring 76 which can be shaped to provide an iris lens-like appearance.

A FIG. 80 is positionable within the interior of lunch box cover compartment 60. This FIG. 80 will be sized and costumed to be interactive with the exterior motif of the lunch box 20. In the depicted preferred embodiment, since lunch box 20 has a rocket ship 46 as an exterior motif, the interactive FIG. 80 will be depicted as a rocket ship crewperson and will be suitably attired. The FIG. 80 may be provided with a seat 82 and a workstation or table 84 at which to be seated. Although not specifically depicted in the drawings, it will be understood that the interior of the exteriorly accessible compartment, generally at 60, may be provided with suitable molded gauges, panels and other accessories which will further the exterior motif depicted on the body 24 of the lunch box 20.

Figure 4:
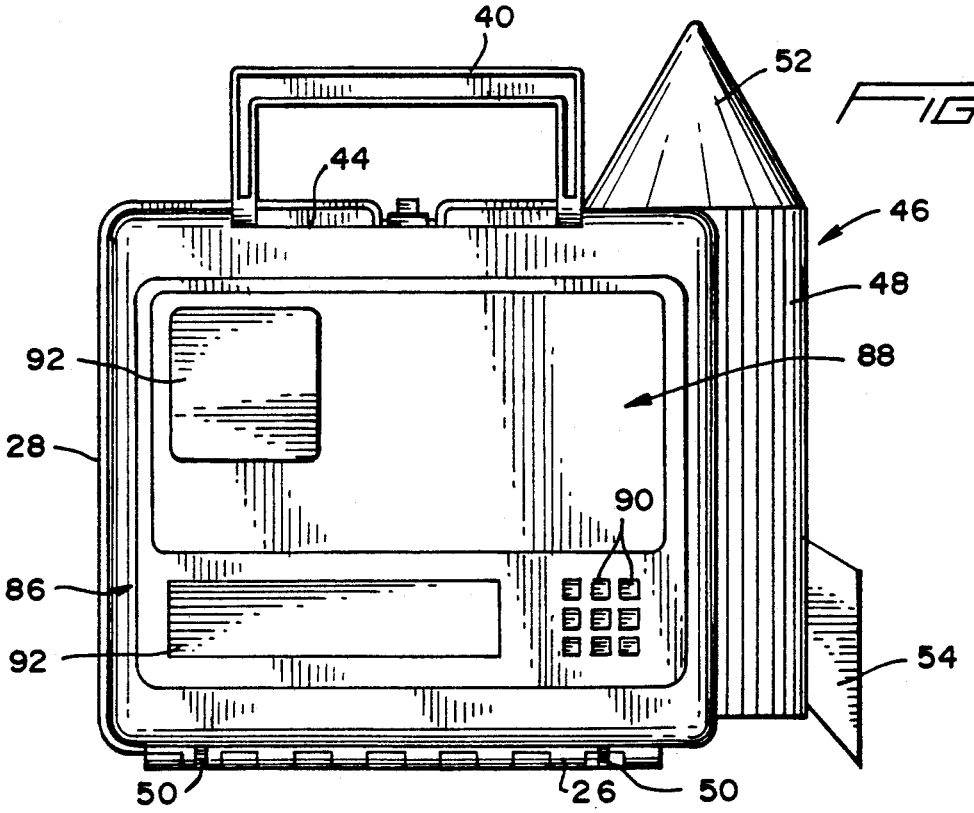
FIG. 4 is a rear elevation view of the lunch box.
Figure 5:
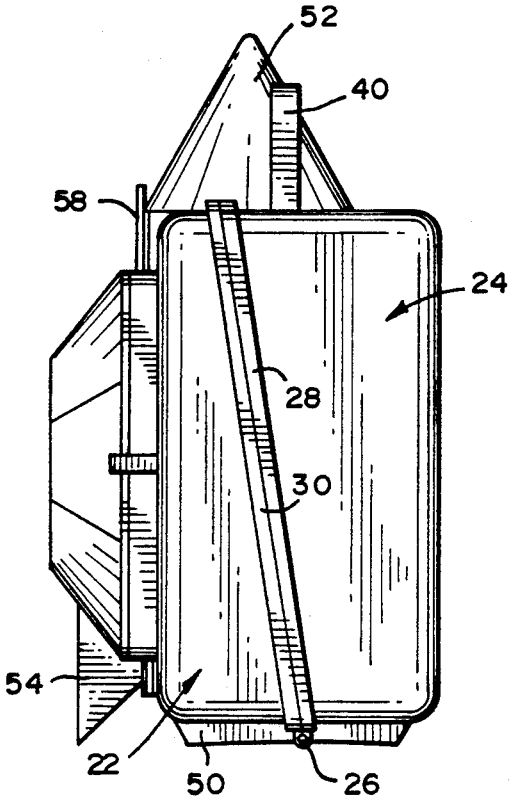
FIG. 5 is a right side elevation view of the lunch box.
Figure 6:
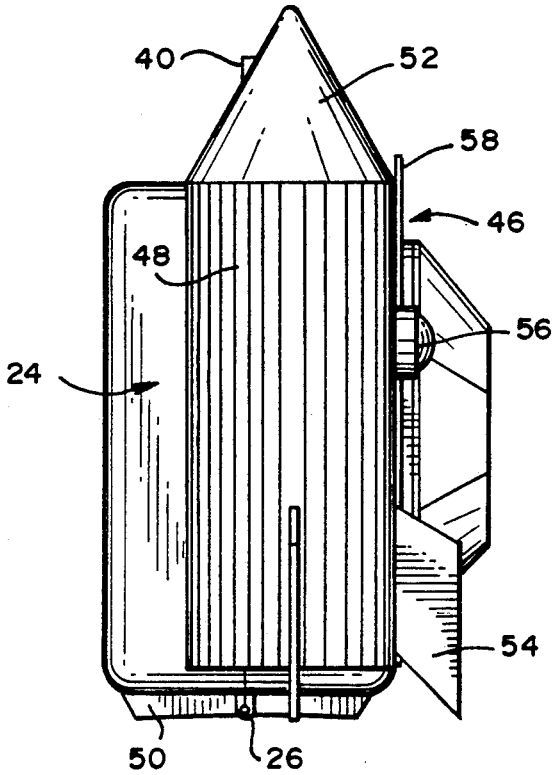
FIG. 6 is a left side elevation view of the lunch box of FIG.
Figure 7:
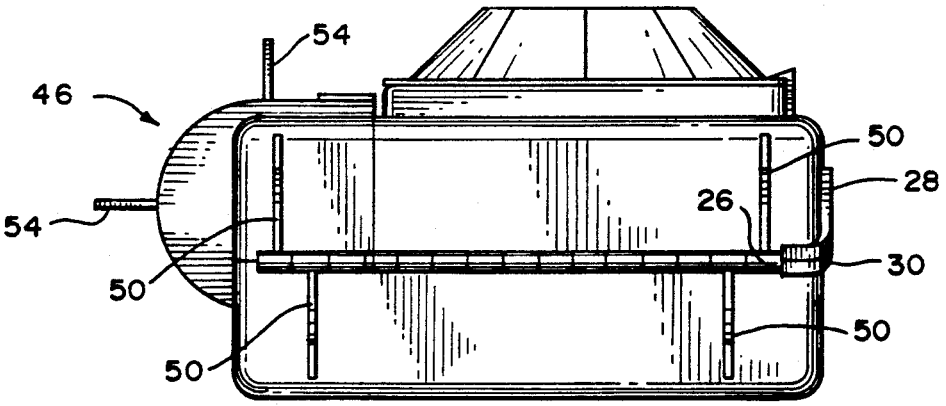
FIG. 7 is a bottom plan view of the lunch box.

Turning now to FIG. 4, the rear of the body 24 of the lunch box 20 is shown generally at 86. This rear portion 86 of lunch box body 24 may be molded to simulate a computer screen, generally at 88. Suitable simulative buttons 90 and data entry and display pads 92 may also be provided on the rear surface 86 of lunch box body 24. It will be understood that these buttons, pads and screens, while not being functional, can be provided with suitable coloration and surface characteristics that will make them appear real, especially in the eyes of a child. The use of this exterior computer simulation further enhances the overall exterior motif of the lunch box. It will be understood that this exterior motif is not limited to a rocket ship but can, as will be discussed shortly, take a number of forms.

Figure 8:
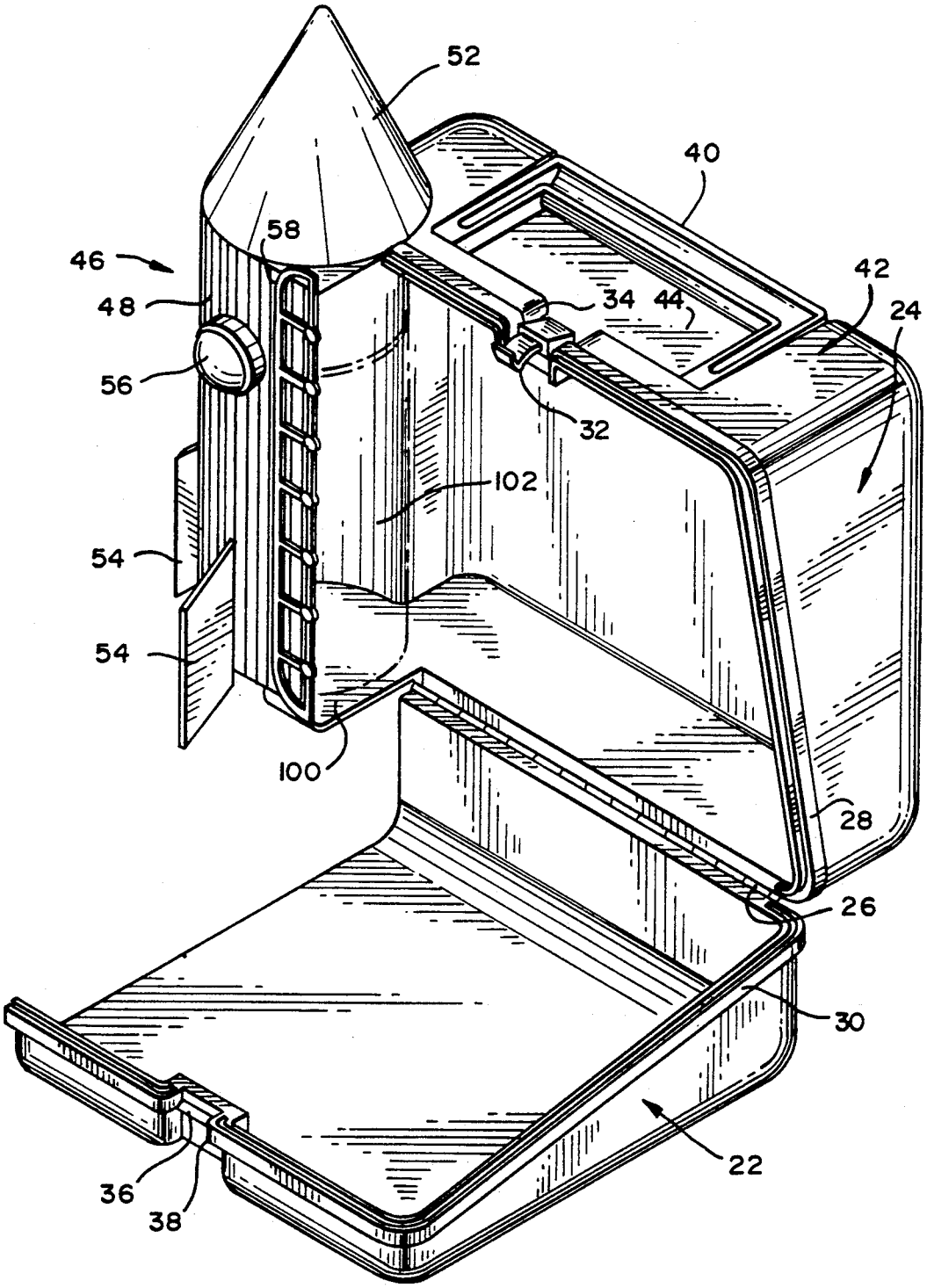
FIG. 8 is a front perspective view of the lunch box of FIG. 1 and showing the lunch box cover open.

Turning now to FIG. 8, a first preferred embodiment of an interior of the lunch box 20 in accordance with the present invention will be seen. In this first preferred embodiment, an interior storage space generally at 100 is formed in the body 24 of lunch box 20 by the hollow cylindrical rocket body portion 48 of the lunch box body 24. This interior storage space 100 is sized to receive a small removable insulated beverage holder, depicted in dashed lines at 102. Instead of an insulated beverage holder, this interior storage space 100 could receive a conventional canned beverage, a carton of milk, a box of juice, or the like. If desired, a simple securement strap (not shown) could be provided to hold the beverage container in place during transport of the lunch box. The placement of this beverage holder or container 102 in the cylindrical rocket body interior storage space 100 effectively provides greater storage capacity for the lunch box 20. This storage area would not be available in a conventionally shaped lunch box.

Figure 9:
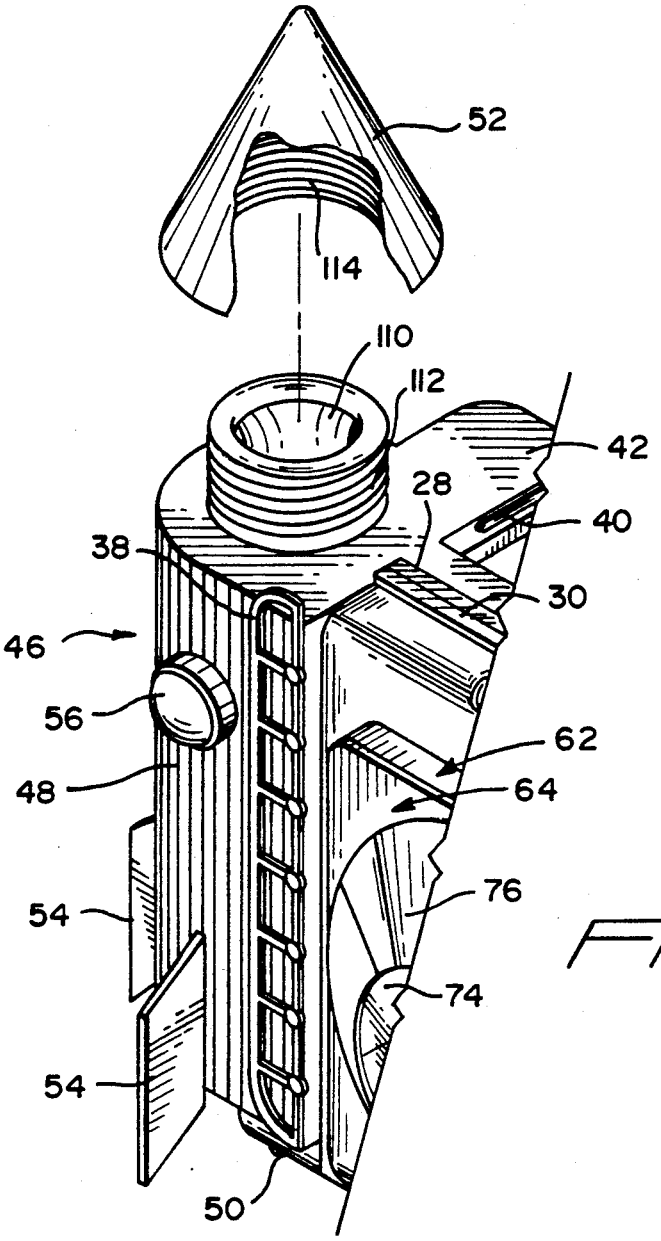
FIG. 9 is a front perspective view of a portion of a second preferred embodiment of a lunch box in accordance with the present invention.

In a second preferred embodiment of the lunch box of the present invention, as depicted in FIG. 9, an insulated beverage storage receptacle is formed integrally with the cylindrical rocket ship body 46 of lunch box body 24. A mouth 110 for the integral receptacle is molded on a portion of the upper surface 42 of the box body 24. This mouth 110 has external threads 112 which engage internal threads 114 formed on the inner surface of the rocket ship nose cone 52. Thus the nose cone 52 acts as a removable cover for the liquid reservoir that in this second preferred embodiment, is defined by the cylindrical portion 46 of the lunch box body 24. It will be understood that in use, the nose cone cover 52 is unscrewed from the mouth threads 112. The lunch box 20 can now be inclined to pour the contents of the integral beverage container into a suitable cup (not shown). In accordance with the invention, the removable cover, whose actual configuration will vary depending on the exterior motif being displayed, can be used as a liquid holding receptacle.

The exterior motif of the lunch box 20, the depiction of the interior of the exteriorly accessible compartment 60, the costume and appearance of the FIG. 80, and the computer screen or other visual display on the rear surface 86 of the body 24 will all be related so that they all interact. In this way, a child using the lunch box 20 will be apt to remove FIG. 80 from compartment 60 and use the figure in conjunction with the lunch box 20 to act out imagined events. The incorporation of the simulated visual display or computer screen on the rear 86 of the body 24 of the lunch box will further allow this interaction between the lunch box 20, the FIG. 80 and the child.

While the exterior motif of the lunch box 20 depicted in the drawings is a rocket ship and the interactive FIG. 80 is depicted as a space man or the like, other interactive exterior motifs and figures are within the scope of the present invention. Although not specifically depicted, it will be understood that the exterior motif of the lunch box can be a castle with the cylindrical body portion 46 being a turret of the castle. In this configuration, the interactive figure could be a princess or a knight. In another configuration, the exterior motif could be a firehouse or police station. In either of these exterior configurations, the hollow upright portion of the body could be configured to resemble a fire truck or a police car. The interactive figure would then be a fireman or firewoman or a policeman or policewoman. Further exterior configurations are also within the scope of the invention but are not specifically set forth herein. Their commonality resides in the incorporation of an exterior motif on the surface of the lunch box, an exteriorly accessible compartment other than for the storage of food, and an interactive figure costumed to complement the exterior motif and sized to be receivable in the exteriorly accessible compartment.

While preferred embodiments of a lunch box in accordance with the present invention have been set forth fully and completely hereinabove, it will be apparent to one of skill in the art that a number of changes in, for example, the type of hinge structures used, the specific lunch box latch and handle configuration, the type of plastics used for the lunch box and the like may be made without departing from the true spirit and scope of the invention, which is accordingly t be limited only by the following claims:

What is claimed is:

1. A lunch box comprising:

a lunch box body and a lunch box cover, said body and cover being hingedly connected;

a simulative exterior motif on at least one surface of said body or cover;

an exteriorly accessible compartment on at least one outer surface of said body or cover; and an interactive figure positionable in said exteriorly accessible compartment, said figure being costumed to interact with and to be coordinated with said simulative exterior motif on said lunch box.

2. The lunch box of claim 1 wherein said simulative exterior motif includes a simulative structure on said at least one surface of said body or cover.

3. The lunch box of claim 2 wherein said simulative structure includes a generally cylindrical shaped portion of said body.

4. The lunch box of claim 3 further including a nose cone on said cylindrical shaped portion of said body wherein said simulative structure is a rocket ship.

5. The lunch box of claim 1 wherein said exteriorly accessible compartment includes a compartment flange defining said compartment.

6. The lunch box of claim 5 further including a compartment door hingedly connected to said exteriorly accessible compartment flange.

7. The lunch box of claim 5 further including a support surface in said exteriorly accessible compartment for supporting said figure in said compartment.

8. The lunch box of claim 5 wherein said compartment door further includes a transparent view panel.

9. The lunch box of claim 3 wherein said simulative structure defines an interior storage space in said lunch box.

10. The lunch box of claim 3 wherein said simulative structure forms a liquid receptacle having a removable closure.

11. The lunch box of claim 2 further including a second simulative structure on a second surface of said body or cover.

* * * * *